US010738659B2

(12) United States Patent
Houck et al.

(10) Patent No.: US 10,738,659 B2
(45) Date of Patent: Aug. 11, 2020

(54) TURBINE NOZZLE PORT SEAL FOR MACHINING

(71) Applicant: SOLAR TURBINES INCORPORATED, San Diego, CA (US)

(72) Inventors: James Houck, Encinitas, CA (US); Jonathan Charbonnet, Chula Vista, CA (US); Jose Molina, Chula Vista, CA (US)

(73) Assignee: Solar Turbines Incorporated, San Diego, CA (US)

( * ) Notice: Subject to any disclaimer, the term of this patent is extended or adjusted under 35 U.S.C. 154(b) by 159 days.

(21) Appl. No.: 15/990,473

(22) Filed: May 25, 2018

(65) Prior Publication Data

US 2019/0360360 A1 Nov. 28, 2019

(51) Int. Cl.

| | |
|---|---|
| ***F01D 25/28*** | (2006.01) |
| ***F01D 9/04*** | (2006.01) |
| ***F01D 25/12*** | (2006.01) |
| ***B25B 5/16*** | (2006.01) |
| ***B25B 5/02*** | (2006.01) |
| ***B25B 5/14*** | (2006.01) |

(52) U.S. Cl.

CPC ..... *F01D 25/285* (2013.01); *B25B 5/02* (2013.01); *B25B 5/14* (2013.01); *B25B 5/163* (2013.01); *F01D 9/041* (2013.01); *F01D 25/12* (2013.01); *F05D 2220/32* (2013.01); *F05D 2230/68* (2013.01)

(58) Field of Classification Search

CPC ..... F01D 25/285; F01D 9/041; B25B 5/14; B25B 5/163

USPC ..... 269/56, 58, 104, 909; 29/235, 237, 238

See application file for complete search history.

(56) References Cited

U.S. PATENT DOCUMENTS

| | | | | |
|---|---|---|---|---|
| 5,985,122 | A | 11/1999 | Conner | |
| 6,006,407 | A | 12/1999 | Roverman et al. | |
| 6,652,369 | B2 * | 11/2003 | Jones | B23Q 3/063 269/238 |
| 7,334,306 | B2 * | 2/2008 | Beverley | B23Q 3/063 269/909 |
| 8,544,173 | B2 | 10/2013 | Miller et al. | |
| 2009/0246012 | A1 | 10/2009 | Shapiro et al. | |

(Continued)

FOREIGN PATENT DOCUMENTS

WO 2008034756 A1 3/2008

*Primary Examiner* — Monica S Carter
*Assistant Examiner* — Alberto Saenz
(74) *Attorney, Agent, or Firm* — Procopio, Cory, Hargreaves & Savitch LLP

(57) ABSTRACT

This disclosure provides a devices and systems for securing a gas turbine nozzle segment and sealing one or more cooling cavities of the gas turbine nozzle segment during manufacturing. The device can have a support assembly for receiving a nozzle segment having at least one cooling cavity. The device can have at least one clamp assembly configured to secure a first portion of the nozzle segment to the support assembly. The at least one clamp assembly having a first clamp arm, and a first tightening assembly coupling the first clamp arm to the support assembly. The device can have a first port seal assembly having at least one sealing member coupled to the first seal body and configured to interact with and seal the corresponding one or more cooling cavities.

15 Claims, 10 Drawing Sheets

(56) References Cited

U.S. PATENT DOCUMENTS

| | | | |
|---|---|---|---|
| 2010/0281689 | A1 | 11/2010 | Beverly et al. |
| 2012/0047734 | A1 | 3/2012 | Miller et al. |

* cited by examiner

TURBINE NOZZLE PORT SEAL FOR MACHINING

BACKGROUND

Technological Field

This disclosure relates to gas turbine engines. More specifically, this disclosure relates to devices and methods for preserving the integrity and cleanliness of newly gas turbine nozzle segment ports during manufacturing.

Related Art

U.S. Pat. No. 8,544,173 to Miller discloses a replacement nozzle for gas turbine engine. A replacement nozzle is cast to include replacement vanes extending between a replacement outer band and an inner web, with the replacement outer band and vanes conforming with the original outer band and vanes. The new web is configured differently than the old inner band and includes a tie bar. The inner band is machined to form vane seats. The web is machined to form plinths atop the tie bar at each of the replacement vanes. The plinths and tie bar are assembled through the vane seats and bonded to the machined inner band to collectively form the repaired turbine nozzle.

SUMMARY

In general, this disclosure describes systems and methods related to devices and methods for sealing nozzle ports during manufacturing an machining. The systems, methods and devices of this disclosure each have several innovative aspects, no single one of which is solely responsible for the desirable attributes disclosed herein.

One aspect of the disclosure provides a device for securing a gas turbine nozzle segment and sealing one or more cooling cavities of the gas turbine nozzle segment during manufacturing. The device can have a support assembly for receiving a nozzle segment having at least one cooling cavity. The device can have a first clamp assembly configured to secure a first portion of the nozzle segment to the support assembly, the first clamp assembly having a first clamp arm, and a first tightening assembly coupling the first clamp arm to the support assembly. The device can have a first port seal assembly. The port seal assembly can have a first seal body hingeably attached to the support assembly. The port seal assembly can have at least one sealing member coupled to the first seal body and configured to interact with and seal the corresponding one or more cooling cavities.

Another aspect of the disclosure provides a device for sealing one or more cooling cavities of a gas turbine nozzle segment during manufacturing. The device can have a support assembly for receiving a nozzle segment having at least one cooling cavity. The device can have a first clamp assembly configured to secure a first portion of the nozzle segment to the support assembly. The first clamp assembly can have a first clamp arm. The first clamp assembly can have a first hinge assembly. The first clamp assembly can have a first port seal coupled to the first clamp arm by the first hinge assembly. The first port seal can have at least one sealing member configured to interact with the corresponding one or more cooling cavities. The first clamp assembly can have a first tightening assembly coupling the first clamp arm to the support assembly and allowing the first clamp assembly to selectively move toward and away from a center of the support assembly. The device can have a second clamp assembly disposed on a second side of the support assembly and configured to secure a second portion of the nozzle segment. The second clamp assembly can have a second clamp arm. The second clamp assembly can have a second tightening assembly coupling the second clamp arm to the support assembly and allowing the second clamp assembly to selectively move toward and away from the center of the support assembly, opposite the first clamp assembly.

Another aspect of the disclosure provides a device for sealing one or more cooling cavities of a gas turbine nozzle segment during manufacturing. The device can have a support assembly for receiving a nozzle segment having at least one cooling cavity. The device can have a first clamp assembly configured to secure a first portion of the nozzle segment, the first clamp assembly having a first clamp arm, and a first securing assembly coupling the first clamp arm to the support assembly. The device can have a first port seal assembly. The first port seal assembly can have a seal body. The first port seal assembly can have at least one sealing member coupled to the seal body and configured to interact with and seal the corresponding one or more cooling cavities. The first port seal assembly can have a seal leg coupled to the seal body and extending away from the seal body opposite the at least one sealing member, the seal leg having a seal leg axis. The first port seal assembly can have a first wall coupled to the support assembly having an aperture to slidably receive the seal leg of the first port seal assembly.

Other features and advantages of the present disclosure should be apparent from the following description which illustrates, by way of example, aspects of the disclosure.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that the disclosure without these specific details. In some instances, well-known structures and components are shown in simplified form for brevity of description.

Figure 1:
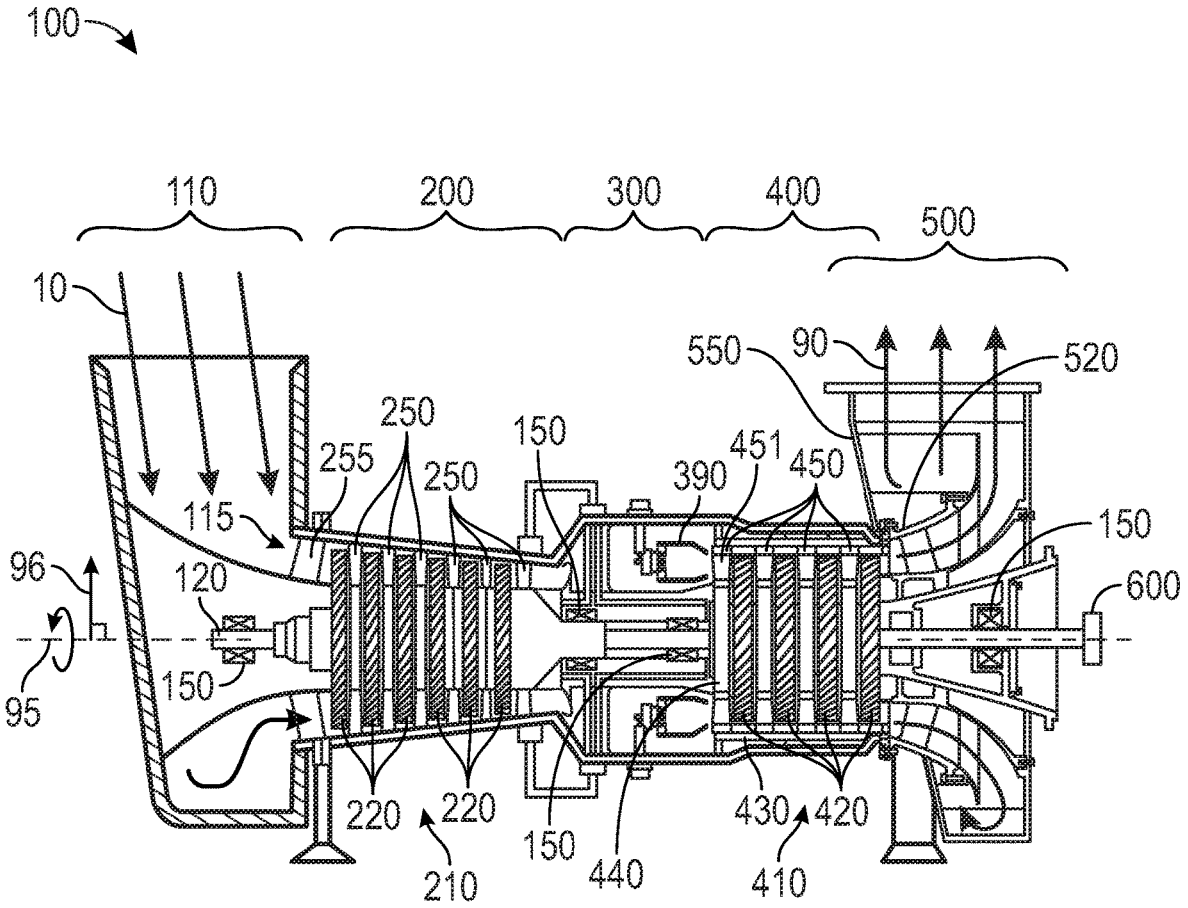
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air 10 (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from center axis 95, wherein a radial 96 may be in any direction perpendicular and radiating outward from center axis 95.

A gas turbine engine 100 includes an inlet 110, a shaft 120, a compressor 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor stationary vanes (stators) 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the compressor stages at the beginning of an annular flow path 115 through the gas turbine engine 100.

The turbine 400 includes a turbine rotor assembly 410 and turbine nozzles 450 within a turbine housing 430. The turbine rotor assembly 410 mechanically couples to the shaft 120. In the embodiment illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. Turbine nozzles 450 axially precede each of the turbine disk assemblies 420. Each turbine disk assembly 420 paired with the adjacent turbine nozzles 450 that precede the turbine disk assembly 420 is considered a turbine stage. Turbine 400 includes multiple turbine stages.

The exhaust 500 includes an exhaust diffuser 520 and an exhaust collector 550 that can collect exhaust gas 90. The power output coupling 600 may be located at an end of shaft 120.

Figure 2:
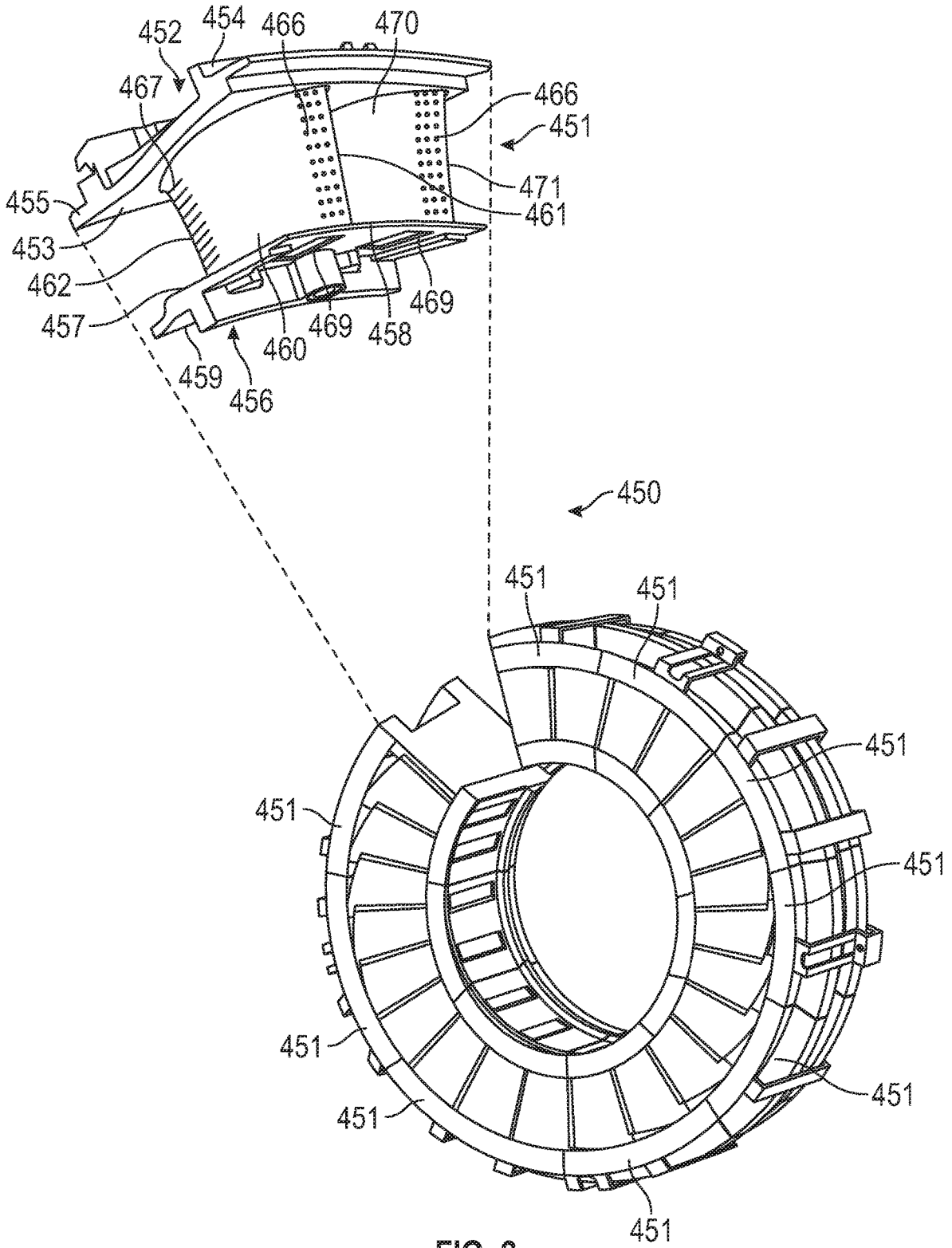
FIG. 2 is a perspective view of a turbine nozzle of the gas turbine engine of FIG. 1 with one turbine nozzle segment shown exploded from the turbine nozzle.

FIG. 2 is a perspective view of a turbine nozzle of the gas turbine engine of FIG. 1. The gas turbine engine 100 can have more than one nozzle 450 as shown in FIG. 1. The turbine nozzle(s) 450 can alternate with the turbine disk assemblies 420.

Each nozzle 450 can have a plurality of turbine nozzle segments (nozzle segments) 451 that can be assembled radially about the center axis 95 to form the complete assembly of the turbine nozzle 450. One turbine nozzle segment 451 is shown exploded from the turbine nozzle 450 in FIG. 2.

The nozzle segment 451 includes upper shroud 452, lower shroud 456, a first airfoil 460, and a second airfoil 470. In other embodiments, nozzle segment 451 can include more or fewer airfoils, such as one airfoil, three airfoils, or four airfoils. Upper shroud 452 may be located adjacent and radially inward from turbine housing 430 when nozzle segment 451 is installed in gas turbine engine 100. Upper shroud 452 includes upper endwall 453. Upper endwall 453 may be a portion of an annular shape, such as a sector. For example, the sector may be a sector of a toroid (toroidal sector) or a sector of a hollow cylinder. The toroidal shape may be defined by a cross-section with an inner edge including a convex shape. Multiple upper endwalls 453 are arranged to form the annular shape, such as a toroid, and to define the radially outer surface of the annular flow path 115 through a turbine nozzle 450. Upper endwall 453 may be coaxial to center axis 95 when installed in the gas turbine engine 100.

Upper shroud 452 may also include upper forward rail 454 and upper aft rail 455. Upper forward rail 454 extends radially outward from upper endwall 453. In the embodiment illustrated in FIG. 2, upper forward rail 454 extends from upper endwall 453 at an axial end of upper endwall 453. In other embodiments, upper forward rail 454 extends from upper endwall 453 near an axial end of upper endwall 453 and may be adjacent to the axial end of upper endwall 453. Upper forward rail 454 may include a lip, protrusion or other features that may be used to secure nozzle segment 451 to turbine housing 430.

Upper aft rail 455 may also extend radially outward from upper endwall 453. In the embodiment illustrated in FIG. 2, upper aft rail 455 is 'L' shaped, with a first portion extending radially outward from the axial end of upper endwall 453 opposite the location of upper forward rail 454, and a second portion extending in the direction opposite the location of upper forward rail 454 extending axially beyond upper endwall 453. In other embodiments, upper aft rail 455 includes other shapes and may be located near the axial end of upper endwall 453 opposite the location of upper forward rail 454 and may be adjacent to the axial end of upper endwall 453 opposite the location of upper forward rail 454. Upper aft rail 455 may also include other features that may be used to secure nozzle segment 451 to turbine housing 430.

Lower shroud 456 is located radially inward from upper shroud 452. Lower shroud 456 may also be located adjacent and radially outward from turbine diaphragm 440 (FIG. 1) when nozzle segment 451 is installed in gas turbine engine 100. Lower shroud 456 includes lower endwall 457. Lower endwall 457 is located radially inward from upper endwall 453. Lower endwall 457 may be a portion of an annular shape, such as a sector. For example, the sector may be a portion of a nozzle ring. Multiple lower endwalls 457 are arranged to form the annular shape, such as a toroid, and to define the radially inner surface of the flow path through a turbine nozzle 450. Lower endwall 457 may be coaxial to upper endwall 453 and center axis 95 when installed in the gas turbine engine 100.

Lower shroud 456 may also include lower forward rail 458 and lower aft rail 459. Lower forward rail 458 extends radially inward from lower endwall 457. In the embodiment illustrated in FIG. 2, lower forward rail 458 extends from lower endwall 457 at an axial end of lower endwall 457. In other embodiments, lower forward rail 458 extends from lower endwall 457 near an axial end of lower endwall 457 and may be adjacent lower endwall 457 near the axial end of lower endwall 457. Lower forward rail 458 may include a lip, protrusion or other features that may be used to secure nozzle segment 451 to turbine diaphragm 440.

The lower aft rail 459 may also extend radially inward from lower endwall 457. In the embodiment illustrated in FIG. 2, lower aft rail 459 extends from lower endwall 457 near the axial end of lower endwall 457 opposite the location of lower forward rail 458 and may be adjacent the axial end of lower endwall 457 opposite the location of lower forward rail 458. In other embodiments, lower aft rail 459 extends from the axial end of lower endwall 457 opposite the location of lower forward rail 458. Lower aft rail 459 may also include a lip, protrusion or other features that may be used to secure nozzle segment 451 to turbine diaphragm 440.

The airfoil 460 extends between the upper endwall 453 and the lower endwall 457. The airfoil 460 includes the leading edge 461, the trailing edge 462, the pressure side wall 463, and the suction side wall 464. The leading edge 461 extends from the upper endwall 453 to the lower endwall 457 at the most upstream axial location where highest curvature is present. The leading edge 461 may be located near the upper forward rail 454 and the lower forward rail 458. The trailing edge 462 may extend from the upper endwall 453 axially offset from and distal to the leading edge 461, adjacent the axial end of the upper endwall 453 opposite the location of the leading edge 461 and from the lower endwall 457 adjacent the axial end of the upper endwall 453 opposite and axially distal to the location of the leading edge 461. When the nozzle segment 451 is installed in the gas turbine engine 100, the leading edge 461, the upper forward rail 454, and the lower forward rail 458 may be located axially forward and upstream of the trailing edge 462, the upper aft rail 455, and the lower aft rail 459. The leading edge 461 may be the point at the upstream end of the airfoil 460 with the maximum curvature and the trailing edge 462 may be the point at the downstream end of the airfoil 460 with maximum curvature. In the embodiment illustrated in FIG. 1, the nozzle segment 451 is part of the first stage turbine nozzle 450 adjacent the combustion chamber 390. In other embodiments, the nozzle segment 451 is located within a turbine nozzle 450 of another stage.

The pressure side wall 463 may span or extend from the leading edge 461 to the trailing edge 462 and from the upper endwall 453 to the lower endwall 457. The pressure side wall 463 may include a concave shape. The suction side wall 464 may also span or extend from the leading edge 461 to the trailing edge 462 and from the upper endwall 453 to the lower endwall 457. The suction side wall 464 may include a convex shape. The leading edge 461, the trailing edge 462, the pressure side wall 463 and the suction side wall 464 may contain a cooling cavity 469 (partially shown in FIG. 3) there between.

The airfoil 460 can have multiple cooling holes or apertures, such as leading edge cooling apertures 466. The leading edge cooling apertures 466 can be pressure side cooling apertures and/or showerhead cooling apertures. The airfoil 460 can also have trailing edge cooling apertures 467. Each cooling hole or cooling aperture 466, 467 may be a channel extending through a wall of the airfoil 460. Each set of cooling apertures 466 may be grouped together in a pattern, such as in a row or in a column.

In the embodiment illustrated in FIG. 2, the nozzle segment 451 includes second airfoil 470. Second airfoil 470 may be circumferentially offset from airfoil 460. Second airfoil 470 may include the same or similar features as airfoil 460 including second leading edge 471 and a second trailing edge (not shown), and various cooling apertures 466, 467. The suction sidewall and pressure sidewall of the airfoil 470 are not labeled in FIG. 2.

The various components of nozzle segment 451 including upper shroud 452, lower shroud 456, airfoil 460, and second airfoil 470 may be integrally cast or metalurgically bonded to form a unitary, one piece assembly thereof.

Figure 3:
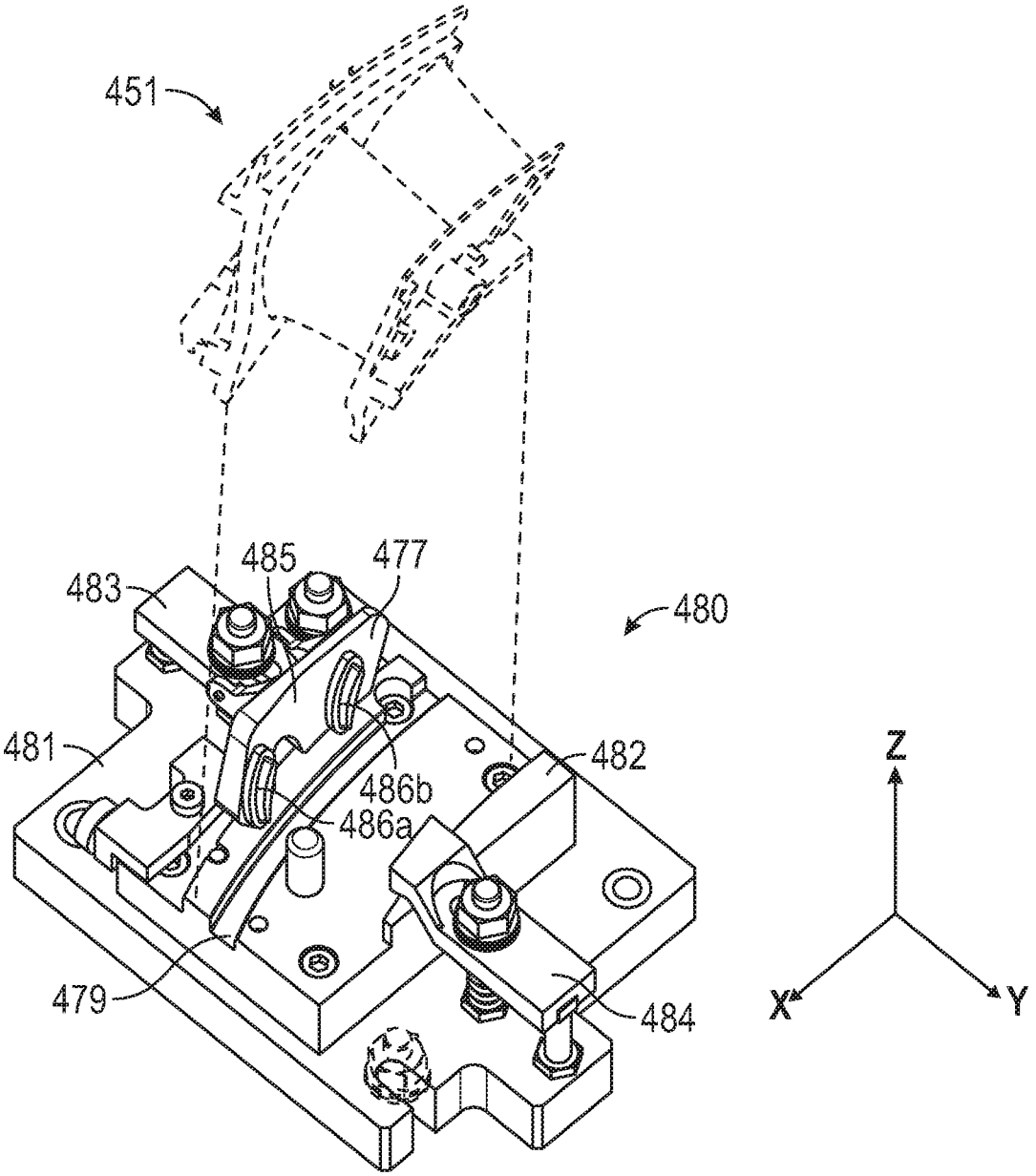
FIG. 3 is a perspective view of a device for sealing the turbine nozzle segment of FIG. 2 during manufacturing.

FIG. 3 is a perspective view of a device for sealing the turbine nozzle segment of FIG. 2 during manufacturing. The nozzle segment 451 is shown in dashed lines indicating how it would be inserted in to the device. In one or more manufacturing, machining, or milling processes, ports, channels, or other cuts may be formed into portions of the nozzle segment 451. For example, the upper aft rail 455 or the lower aft rail 459 may require adjustments or further machining following the initial casting or formation of the component (e.g., the nozzle segment 451). Accordingly, small particles, dust, metal flakes, etc., that result from such processes may be introduced into the cooling cavity 469 within the airfoil 460, 470 for example. The particles introduced may be byproducts of the milling or machining processes and thus can be quite small. These small particles can be caught or lodged within the cooling cavity 469 and obstruct the cooling apertures (e.g., the cooling apertures 466, 467 shown in FIG. 2). For example, particles smaller than approximately 100 microns may be small enough to pass through the nozzle segment 451 and the cooling apertures. However, particles larger than 100 microns may be large enough to obstruct the cooling apertures.

A device 480 can receive and secure the nozzle segment 451 and prevent the metal flakes, dust, or other small particles from entering and clogging the cooling cavity 469 and any holes or other perforations in the nozzle segment 451.

The device 480 can have a platform 481. The platform 481 can generally lie in a horizontal plane. The horizontal plane as shown is the x,y plane. The platform 481 can have a nozzle segment support assembly (support assembly) 482. The support assembly 482 can have a substantially flat surface to receive the nozzle segment 451. The support assembly 482 can have one or more grooves 479 or other features to accommodate the upper aft rail 455 (FIG. 2), for example. The grooves 479 can be oriented laterally across the support assembly 482 running generally parallel to the upper aft rail 455 or the lower aft rail 459. The support assembly 482 can be coupled to the platform 481 by fasteners, bolts, or other applicable hardware.

The support assembly 482 can be coupled to a first clamp assembly 483 and a second clamp assembly 484. The first clamp assembly 483 and the second clamp assembly 484 can receive and secure the nozzle segment 451 (shown in dashed lines). The groove(s) 479 can also be oriented horizontally (e.g., x-axis) to run between first clamp assembly 483 and the second clamp assembly 484.

The first clamp assembly 483 can further include a port seal assembly (port seal) 485. The port seal 485 can have one or more sealing members 486 coupled to a seal body 477. Two sealing members 486 are shown, labeled individually as sealing member 486*a* and sealing member 486*b*. Each of the sealing members 486 can have a polymer structure sized to be received within an associated cooling cavity 469 within the nozzle segment 451. In some embodiments the sealing members 486 can have a foil shape. The sealing members 486 can be formed from any elastomeric compound. In some embodiments, it may be a urethane compound. In some other embodiments, the sealing members may be formed of a rigid material, such as a 3-D printed metallic construction. Any of the sealing members disclosed herein can be formed in the above-described ways.

The first clamp assembly 483 and the second clamp assembly 484 can generally move in the horizontal (x,y) plane, or toward and away from the nozzle segment 451.

Figure 4:
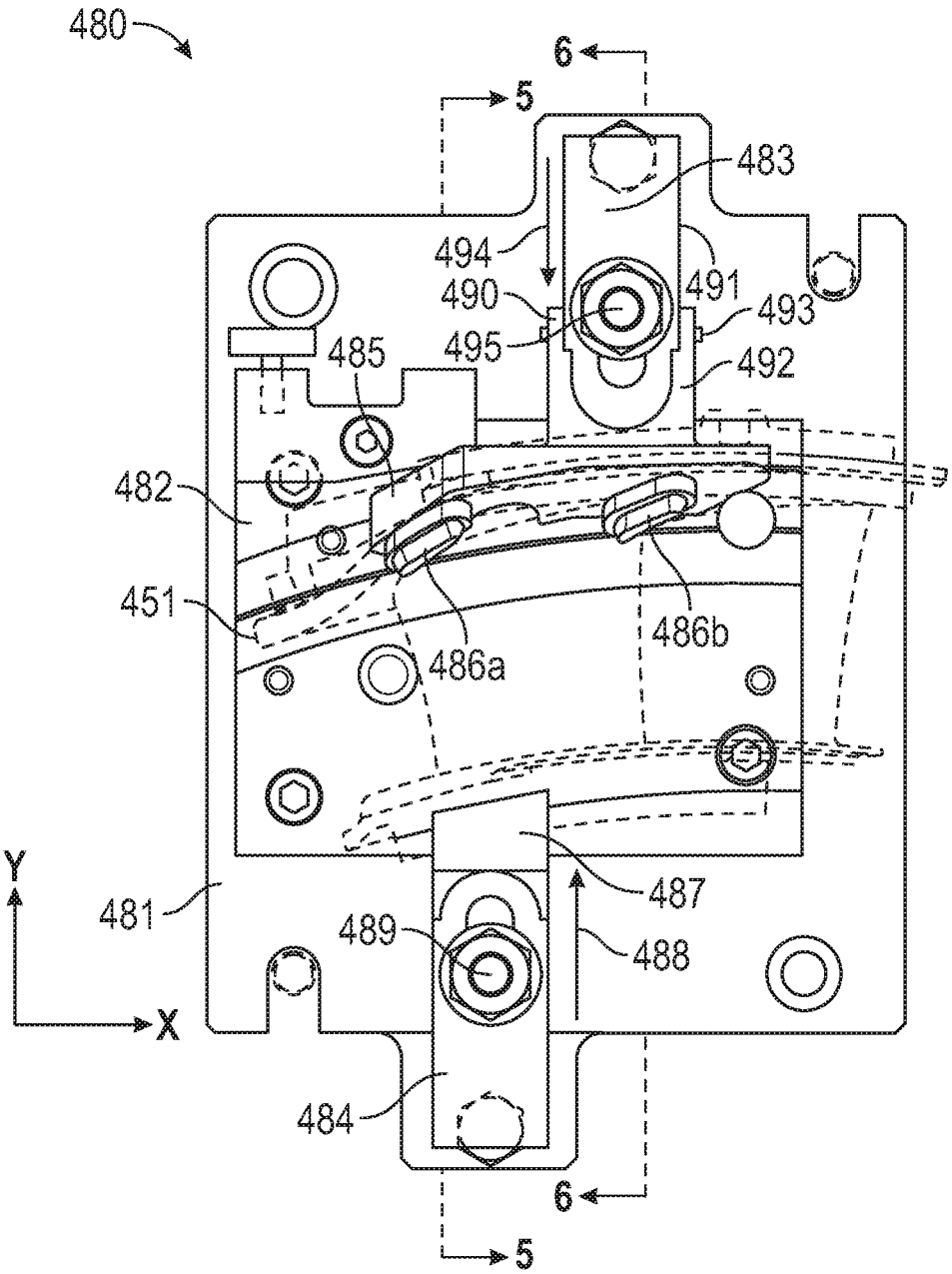
FIG. 4 is a top plan view of the device of FIG. 3.

FIG. 4 is a top plan view of the device of FIG. 3. The device 480 can receive the nozzle segment 451 (shown in dashed lines) and secure it in place on the platform 481 for further machining, for example. The second clamp assembly 484 can have a clamp arm 487 that can move in a (horizontal) direction indicated by the arrow (direction) 488. The clamp arm 487 can then be secured in place by a tightening assembly 489. The tightening assembly 489 can be for example a threaded post or bolt and associated nut and washer as depicted. Other securing means such as a latch, lever, fastener, or other friction-based components are also possible. The tightening assembly 489 can further have a spring 476 or other elastic member configured to raise or lift the clamp arm 487 away from the nozzle segment when the tightening assembly 489 is loosened. The tightening assembly 489 (as with other embodiments of securing or tightening assemblies disclosed herein) can also have the spring 476, even though not specifically stated. Therefore the tightening assemblies or the securing assemblies disclosed herein can allow the corresponding clamp arm (or hinge support arm as needed) to selectively move toward and away from nozzle segment 451 (e.g., the center of the support assembly 482). This can be done by loosening or tightening the associated hardware.

The first clamp assembly 483 can have a hinge assembly 490. The hinge assembly 490 can have a hinge support member 491, or clamp arm, coupled to a hinge arm 492 at a pivot point 493. The hinge arm 492 can also be referred to as an actuation arm. The hinge assembly 490 can include a pin extending through the hinge arm 492 and the hinge support member 491 coincident with the pivot point 493. The pin can generally extend along the x-axis shown in FIG. 4. Thus the hinge arm 492 can pivot about point 493 in the y,z plane (FIG. 3). For example, the hinge assembly 490 allows the port seal 485 to rotate in an arcuate path (e.g., direction 602 of FIG. 6) substantially perpendicular to the support assembly 482.

The hinge assembly 490 (and the first clamp assembly 483 more generally) can further be adjusted in the (e.g., horizontal) direction indicated by an arrow (direction) 494. The hinge support member 491 can slide in the direction 494 and be secured in place by a tightening assembly 495. The tightening assembly 495 can be similar to the tightening assembly 489. The tightening assembly 495 can include a threaded post or bolt and corresponding nut, or other friction-based components, for example, to secure the first clamp assembly 483 in place.

Figure 5:
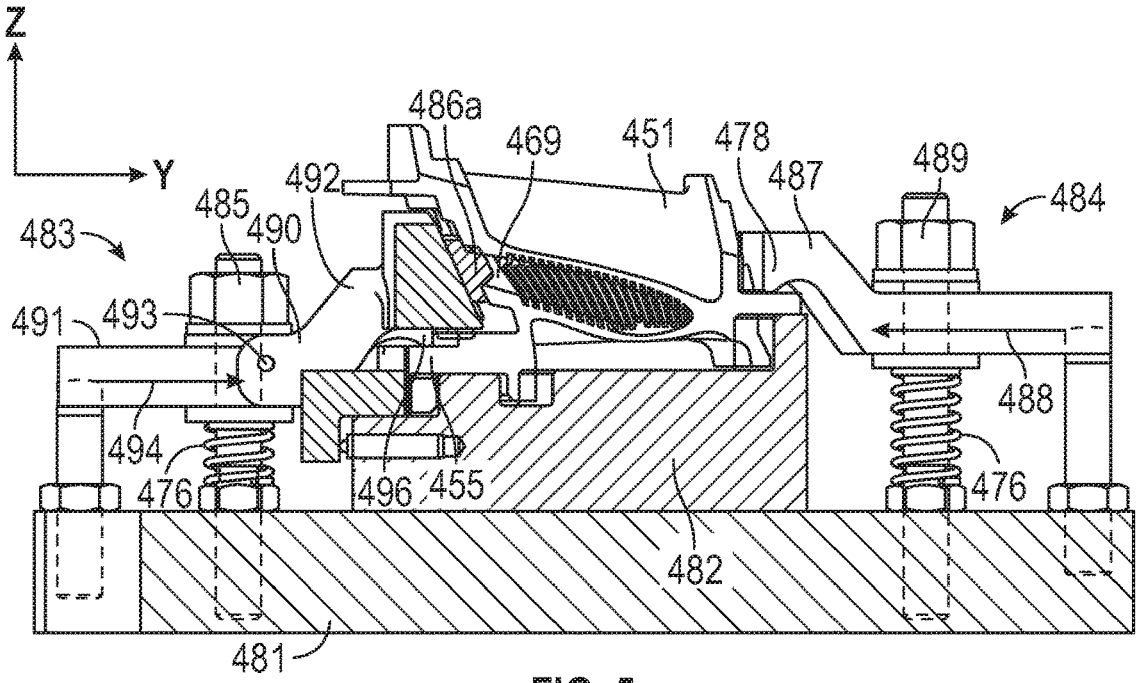
FIG. 5 is a cross section of the device of FIG. 4, taken along line 5-5.

FIG. 5 is a cross section of the device of FIG. 4, taken along line 5-5. The cross-section of FIG. 5 depicts the interior structure of the nozzle segment 451 and the cooling cavity 469 within the nozzle segment 451. When secured in place, the sealing member 486*a* a can plug the opening of the cooling cavity 469 on one side of the nozzle segment 451.

The nozzle segment 451 can be secured in place on the support assembly 482 using the first clamp assembly 483 and the second clamp assembly 484. On one side of the nozzle segment 451, the hinge arm 492 of the hinge assembly 490 and the first clamp assembly 483, can be rotated about the pivot point 493 (e.g., on the x-axis and in the y, z plane) toward the nozzle segment 451 and into place. The first clamping assembly 483 and by extension, the sealing members 486 can be slid in toward the nozzle segment (in direction 494) such that the sealing members 486 are inserted into the cooling cavity 469. The sealing members 486 can have an external shape similar to the shape of the opening of the cooling cavity 469 and thus seal the opening of the cooling cavity 469. This can prevent particulate matter from various machining processes from entering the cooling cavity 469 and clogging the cooling apertures 466 or the trailing edge cooling apertures 467.

In addition, a clamp arm end 496 that extends horizontally from the hinge support member 491, can contact a portion of the nozzle segment 451 such as the upper aft rail 455 to hold the nozzle segment 451 in place.

The opposite portion of the nozzle segment 451 can be secured in place on the support assembly 482 by sliding the clamp arm 487 horizontally toward the nozzle segment 451 (direction 488) and tightening the tightening assembly 489 to prevent the clamp arm 487 from sliding. The clamp arm 487 can have a clamp arm end 478 configured to contact or engage with a portion of the nozzle segment 451 such as the lower aft rail 459 (or other relevant portion of the nozzle segment 451) to hold the nozzle segment 451 in place. The clamp arm end 478 can have a curved or hook shape allowing more precise clamping or fitting for the nozzle segment 451.

Figure 6:
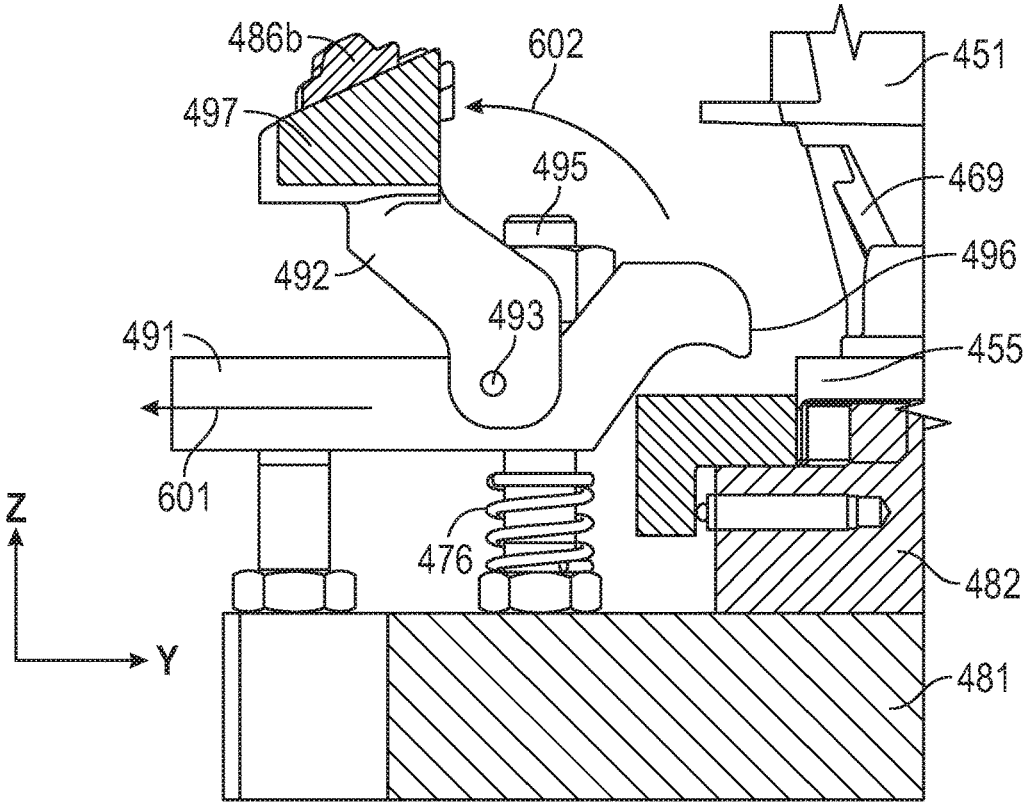
FIG. 6 is a cross section of the device of FIG. 4 taken along the line 6-6.

FIG. 6 is a cross section of the device of FIG. 4 taken along the line 6-6. To release the nozzle segment 451 from the first clamp assembly 483, the tightening assembly 495 can be loosened. The hinge support member 491 and thus the clamp arm end 496 can be retracted from the upper aft rail 455 in a direction indicated by an arrow (direction) 601. At the same time, the hinge arm 492 and the sealing members 486 (486*b*, as shown) can be rotated about the pivot point 493 (e.g., in the x-axis) in the vertical plane away from the nozzle segment 451 in a direction indicated by an arrow (direction) 602.

Figure 7:
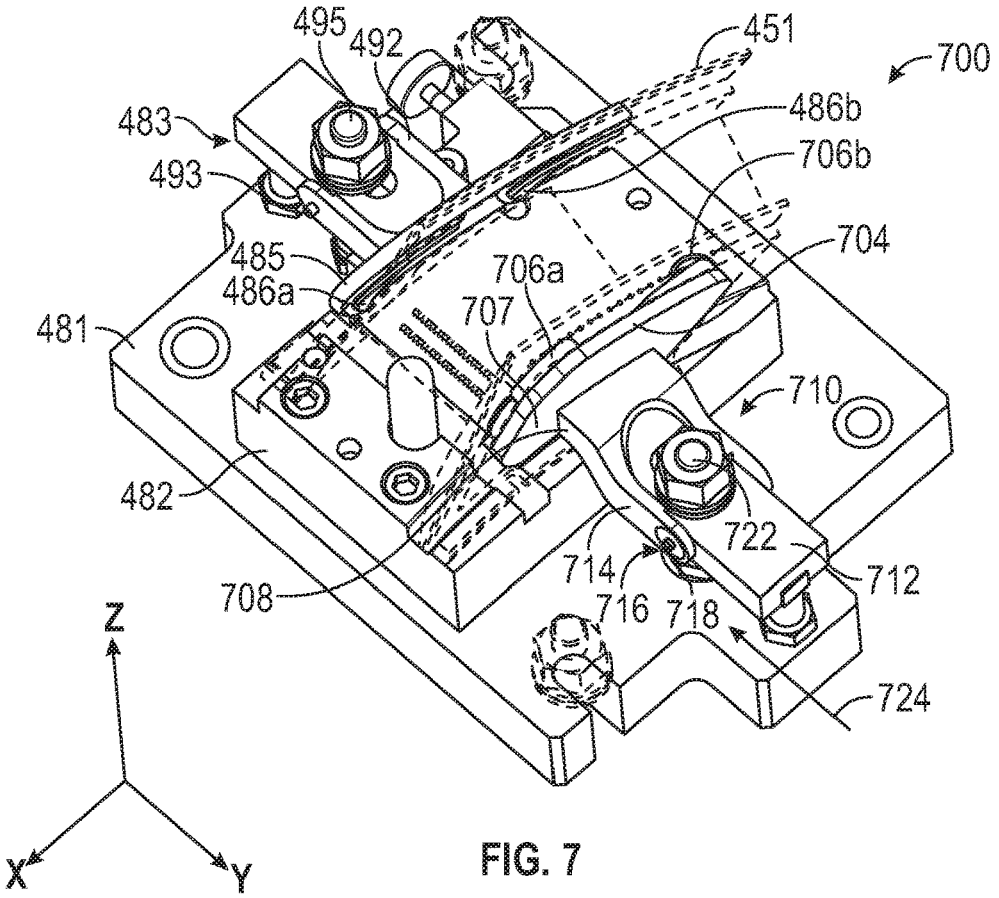
FIG. 7 is a perspective view of another embodiment a device for sealing the turbine nozzle segment of FIG. 2 during manufacturing.

FIG. 7 is a perspective view of another embodiment a device for sealing the turbine nozzle segment of FIG. 2 during manufacturing. A device 700 can be used to seal the turbine nozzle segment 451 during manufacturing similar to the embodiments described in the foregoing. In some embodiments, the device 700 can be similar to the device 480 (FIG. 4), having many of the same features. For example, the device 700 can have the platform 481, the support assembly 482, and the first clamp assembly 483 to name a few.

In some embodiments, the device 700 can have a second clamp assembly 710. The second clamp assembly 710 can have a hinge support member, or hinge support 712. The second clamp assembly 710 can have a hinge arm 714 rotatably coupled to the hinge support 712 at a hinge assembly 716. The hinge arm 714 can also be referred to as an actuation arm. The hinge arm 714 can have a hinge arm end 708 distal to the hinge assembly 716. The hinge arm end 708 can be coupled to a port seal 704. The port seal 704 can be similar to the port seal 485 (FIG. 3). The port seal 704 can have a port seal platform 707, or seal body, having one or more sealing members 706 (shown as sealing members 706*a*, 706*b*). The sealing members 706 can be similar to the sealing members 486. The sealing members 706 can engage with the cooling cavity 469 on an opposite side of the nozzle segment 451 from the sealing members 486. The sealing members 706 can have an elastic, polymer, or elastomer construction and a profile similar to that of the cooling cavity so as to form an airtight seal with the cooling cavity. In some examples, the sealing members 706 function similar to a cork in a bottle. The sealing members 706 can have a profile similar to that of the opening of the cooling cavity 469, such as an airfoil.

The hinge assembly can have a pin 718 that allows the hinge arm 714 and thus the sealing members 706, to rotate about the x-axis and the pin 718 and in the y,z plane. This can allow the port seal 704 to be rotated away from the support assembly 482 and allow insertion of the nozzle segment 451. The port seal 704 can thus rotate in an arcuate path toward and away from the secured nozzle segment 451. The arcuate path may line in a substantially vertical plane.

The second clamp assembly 710 can also have a tightening assembly 722. The tightening assembly 722 can be similar to the tightening assemblies 489, 495. The tightening assembly 722 can be loosened to allow the hinge support arm 712 and thus the port seal 704 to slide horizontally (e.g., along the y-axis) in the direction of an arrow (direction) 724. Similar to the tightening assemblies 489, 495, the tightening assembly 712 can allow adjustment of the port seal 704 toward or away from the nozzle segment 451.

In some embodiments, the second clamp assembly 710 and the hinge support arm 712 can have a clamp arm end (not shown in this view), similar to the clamp arm end 496 (FIG. 6) configured to engage the nozzle segment 451 (opposite the first clamp assembly 483) when tightened with the tightening assembly 722.

Figure 8:
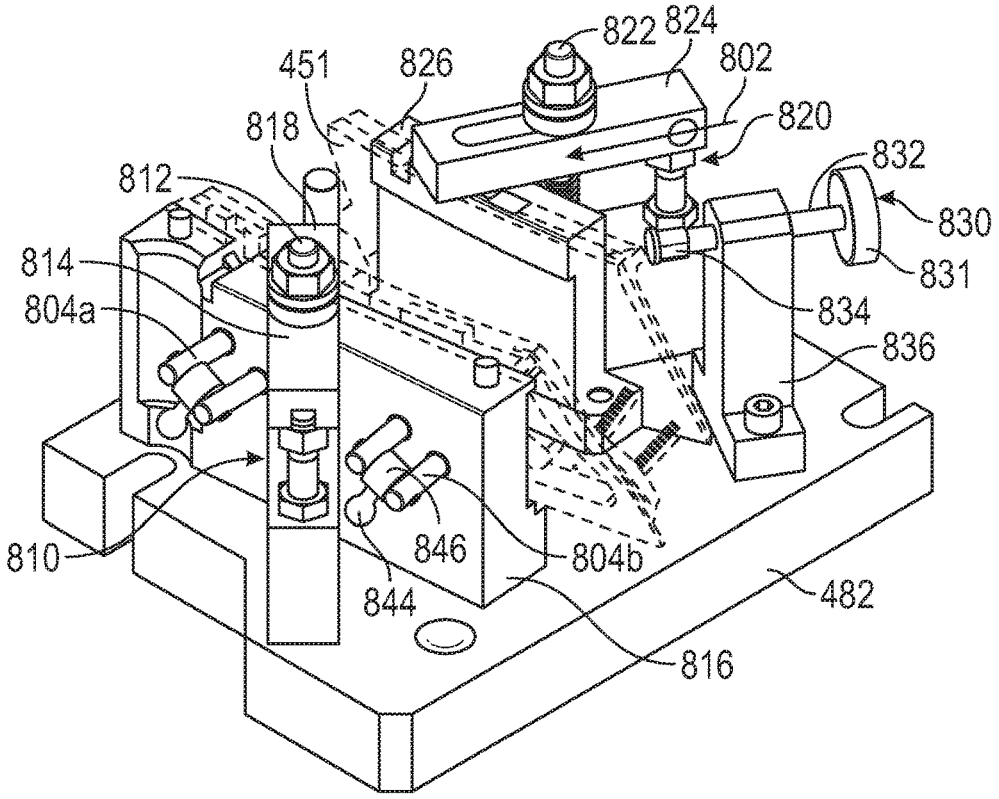
FIG. 8 is a perspective view of another embodiment a device for sealing the turbine nozzle segment of FIG. 2 during manufacturing.

FIG. 8 is a perspective view of another embodiment a device for sealing the turbine nozzle segment of FIG. 2 during manufacturing. A device 800 can receive the nozzle segment 451 between a first clamp assembly 810 and a second clamp assembly 820 on the support assembly 482. The first clamp assembly 810 and the second clamp assembly 820 can be adjusted to secure the nozzle segment 451 and secure it during machining or milling.

The first clamp assembly 810 can have a securing assembly 812. The first clamp assembly 810 can have a clamp arm 814. The clamp arm 814 can slide toward and away from a central portion of the platform 481 (and the nozzle segment 451) along the securing assembly 722. The securing assembly 812 can be similar to the tightening assemblies 489, 495, having a threaded post or bolt and corresponding nut used to secure the clamp arm 814 in place between the clamp arm 814 and the support assembly 482.

The clamp arm 814 can extend toward the center (or central portion) of the platform 481 (and toward the nozzle segment 451, in use), having a first clamp arm end 818. The first clamp arm end 818 can contact a portion of the nozzle segment 451 to retain the nozzle segment 451 securely in place within the device 800.

The device 800 can also have one or more port seals 804 extending through a wall 816 in the clamp assembly 810. As described in connection with FIG. 10, the port seal 804 can seal the cooling cavity 469 of the nozzle segment 451.

The second clamp assembly 820 can have a second securing assembly 822. The second clamp assembly 820 can have a second clamp arm 824. The second clamp arm 824 can slide toward and away from the nozzle segment 451 along the second securing assembly 822. The second securing assembly 822 can be similar to the tightening assemblies 489, 495, having a threaded post or bolt and corresponding nut used to secure the clamp arm 824 in place.

The device 800 can further have a plunger 830. The plunger 830 can have a thumb wheel 831 coupled to a post 832. The post can be coupled to a plunger foot 834. The post 832 can further be threaded within a plunger mount 836. The plunger 830 can be used to further secure the nozzle segment 451 within the device 800 by rotation of the thumb wheel 831. The thumb wheel 831 can be rotated to move the plunger foot 834 toward the center of the platform 481 and in a direction similar to the direction 802.

Figure 9:
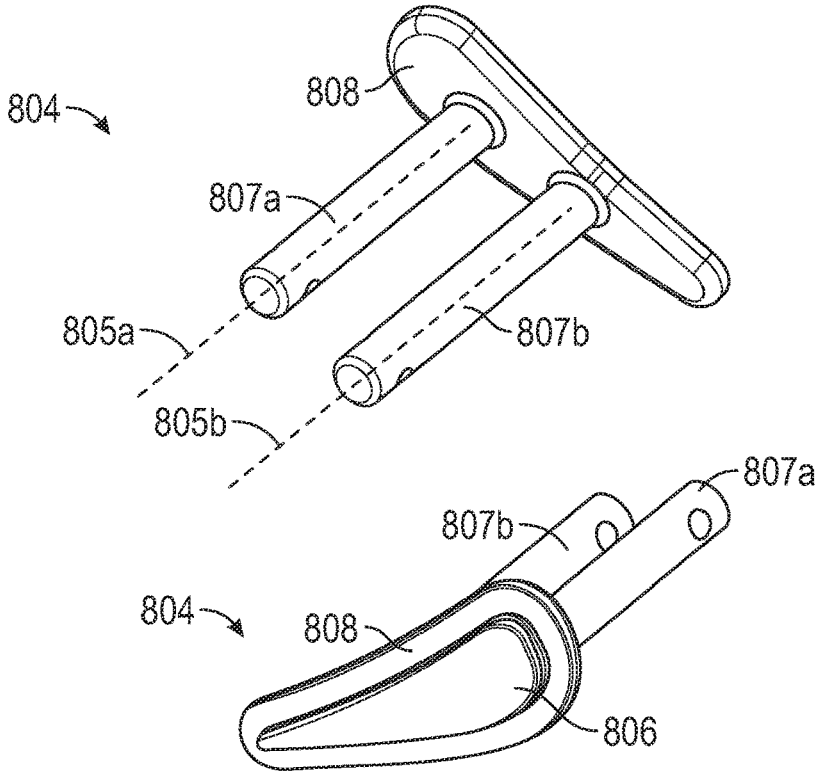
FIG. 9 is a perspective view of the port seals of FIG. 8. The port seals 804 can have a sealing member 806.

FIG. 9 is a perspective view of the port seals of FIG. 8. The port seals 804 can have a sealing member 806. The sealing member 806 can be formed of a rubber or other polymer type substance. The sealing member 806 can be similar to the sealing members 486, 706 and seal the cooling cavity 469 of the nozzle segment 451, for example. The sealing member 806 can have a shape corresponding to that of the opening of the cooling cavity 469. The sealing member 806 is shown having a foil-shaped profile, however this is not limiting on the disclosure. The sealing member 806 can have any shape, corresponding to that of the opening of the cooling cavity 469.

Figure 10:
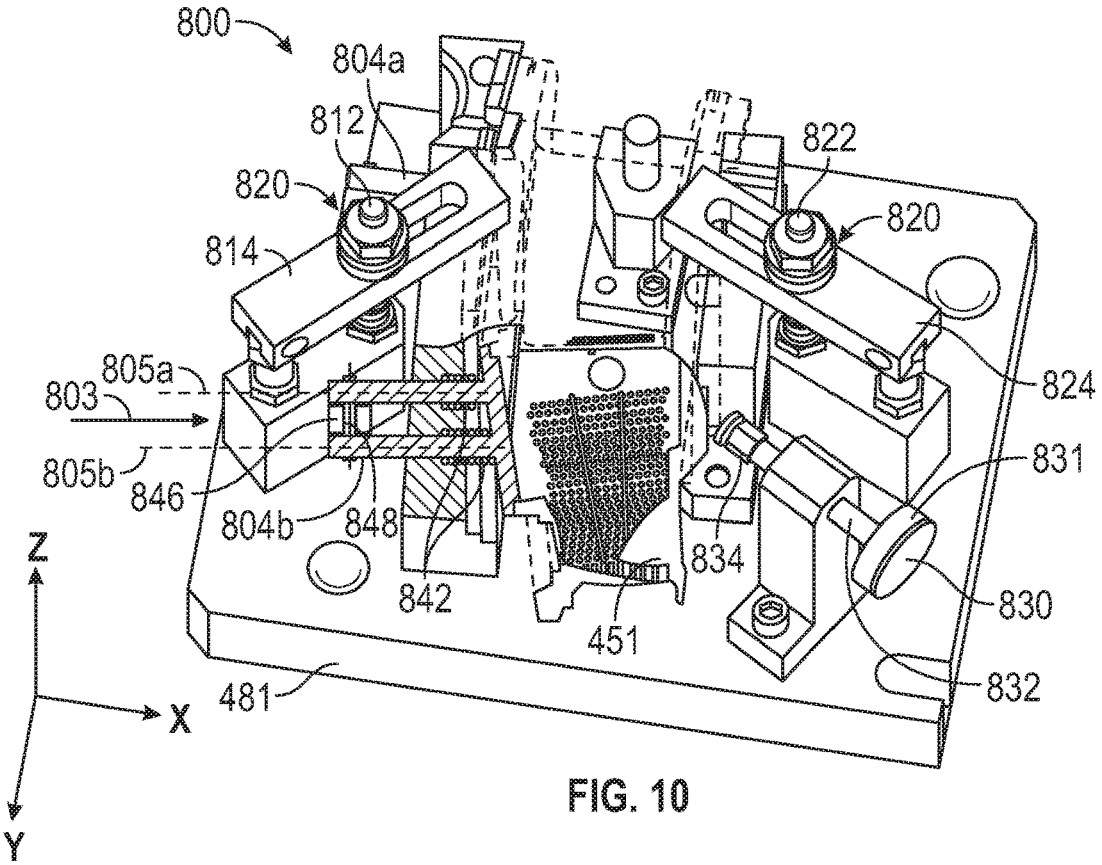
FIG. 10 is a perspective view of the device of FIG. 8, showing a cutaway of the port seal and nozzle segment.

The port seal 804 can have a seal platform 808. The seal platform 808 can provide a rigid support for the sealing member 806. The seal platform 808 can further provide a connection to seal legs 807. The seal legs 807 are shown as seal legs 807*a* and 807*b*. The seal legs 807 can extend through the wall 816, in use. The seal legs 807 can each have a leg axis 805 (shown as 805*a*, 805*b*). The seal legs 807 extend from the seal platform 808 substantially parallel to one another and orthogonal to the seal platform 808. The seal legs 807 can further extend through coaxial springs 842 (FIG. 10). The coaxial springs 842 can exert a force on the seal platform 808 pushing the port seal 804 in the direction of an arrow (direction) 803.

FIG. 10 is a perspective view of the device of FIG. 8, showing a cutaway of the port seal and nozzle segment. The device 800 can have one or more port seals 804 based on the number of cooling cavities 469 present in the nozzle segment 451. The device 800 is shown, with a portion of the wall 816 removed, exposing the port seal 804*b*. The seal legs 807 of the port seal 804*b* extend through the wall 816 and coaxial springs 842. The coaxial springs 842, supported on one end by the wall 816, impart a force on the seal platform 808 pushing the sealing member 806 toward the center of the support assembly 482. When the nozzle segment 451 is present, the coaxial springs 842 provide a force pushing the port seals 804 toward the nozzle segment 451, sealing the cooling cavities 469. The coaxial springs 842 can be received on the seal legs 807 can rest (e.g., be compressed) between the seal platform 808 and the wall 816. The port seals 804 can then move along the axes 805 in and out of the wall 816, or toward and away from the center of the support assembly 482.

The plunger 830, the first clamp assembly 810, and the second clamp assembly 820 can secure the nozzle segment 451 in place opposing the force exerted on the nozzle segment 451 by the springs 842. The plunger 830 can be used to adjust the angle of the nozzle segment in the grooves 479 (FIG. 3) or further secure it to the support assembly 482, for example.

In some embodiments, the device 800 and the port seals 804 can further have adjustment levers 844. The adjustment levers 844 can be coupled to respective barrels 846 and axles 848. The barrels 846 can have an eccentric external profile. Thus when moving the adjustment lever 844 about the axle 848, the barrels 846 can push the port seals toward the secured nozzle segment 451.

Figure 11:
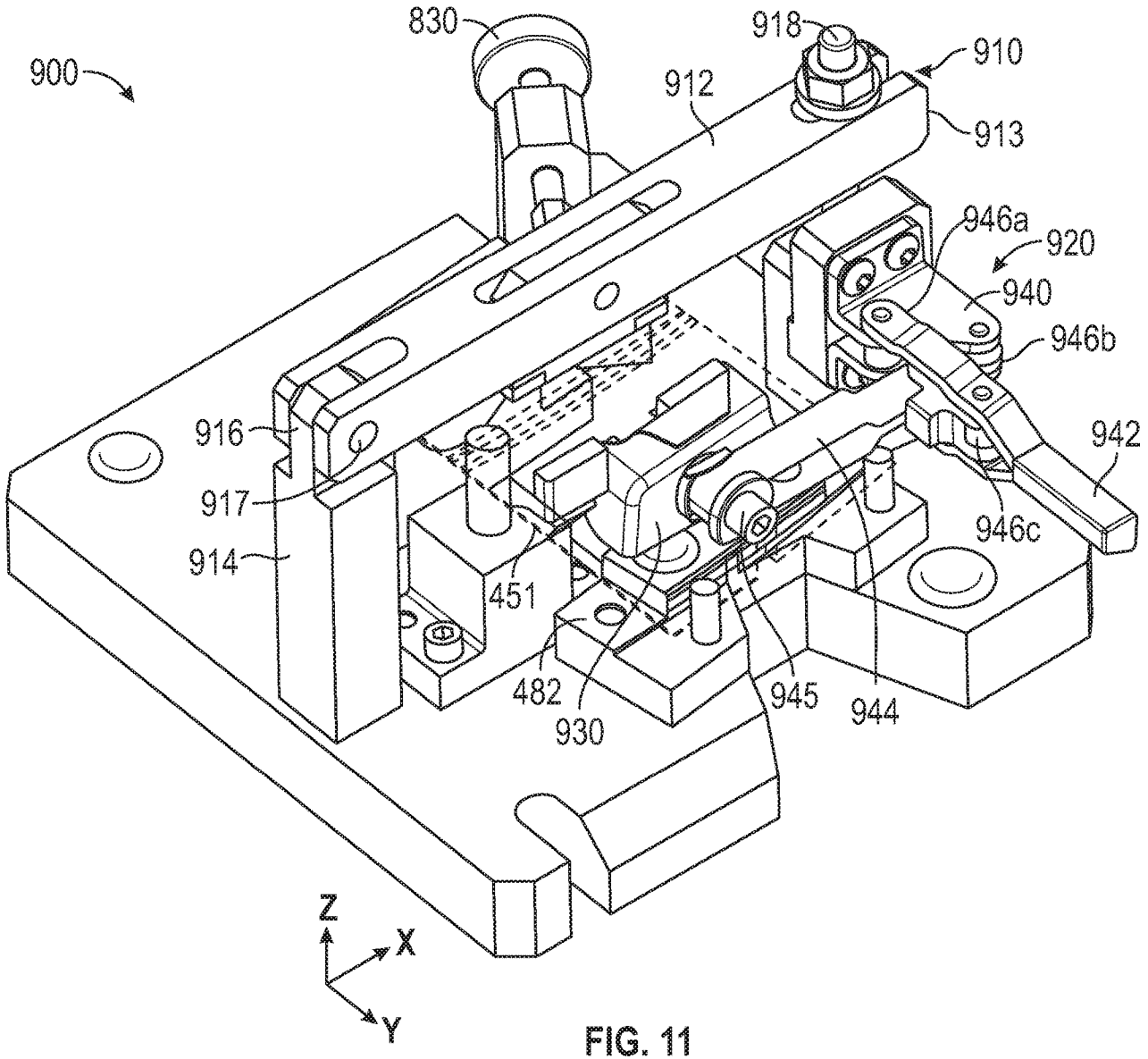
FIG. 11 is another embodiment of a device for sealing the turbine nozzle segment of FIG. 2 during manufacturing.

FIG. 11 is another embodiment of a device for sealing the turbine nozzle segment of FIG. 2 during manufacturing. A device 900 can have a similar function as the devices 480, 700, 800, securing the nozzle segment 451 and sealing the cooling cavities 469 to prevent contamination during milling or machining. The device 900 can have a first clamp assembly 910. The first clamp assembly 910 can have a clamp arm 912. The clamp arm 912 can be coupled to a hinge support 914 at a hinge assembly 916 having a pivot point 917. The clamp arm 912 can pivot about the pivot point 917 in the x-z plane and about the y-axis (shown in FIG. 11), substantially orthogonal to the support assembly 482. The movement of the clamp arm 912 can provide sufficient clearance to place the nozzle segment 451 onto support assembly 482.

The clamp arm 912 can be secured in place at a clamp arm distal end 913 by a tightening assembly 918. Similar to other tightening assemblies disclosed herein, the tightening assembly 918 can have a threaded post or bolt and corresponding nut as needed to secure the clamp arm 912 (and the nozzle segment 451) in place on the support assembly 482. The device 900 can also have the plunger 830 (FIG. 8). As described above, the plunger 830 can be used apply pressure to the nozzle segment 451 in the x- and y-axes and adjust the positioning of the nozzle segment 451 upon the support assembly 482.

The device 900 can have a port seal assembly 920. The port seal assembly 920 can have a port seal 930 and an actuation assembly 940. The port seal 930 is described in more detail below. The actuation assembly 940 can have a lever 942 coupled to the port seal 930 via an actuation arm 944 and one or more hinge assemblies 946. Three hinge assemblies 946 (946*a*, 946*b*, 946*c*) are shown in FIG. 11, however this is not limiting on the disclosure. The actuation assembly 940 is configured to move the port seal 930 into a position to cover the cooling cavities 469; accordingly, the hinge assemblies 946 can provide a lever action to perform the (horizontal, x-y plane) movement and secure the port seal 930 in place.

Figure 12:
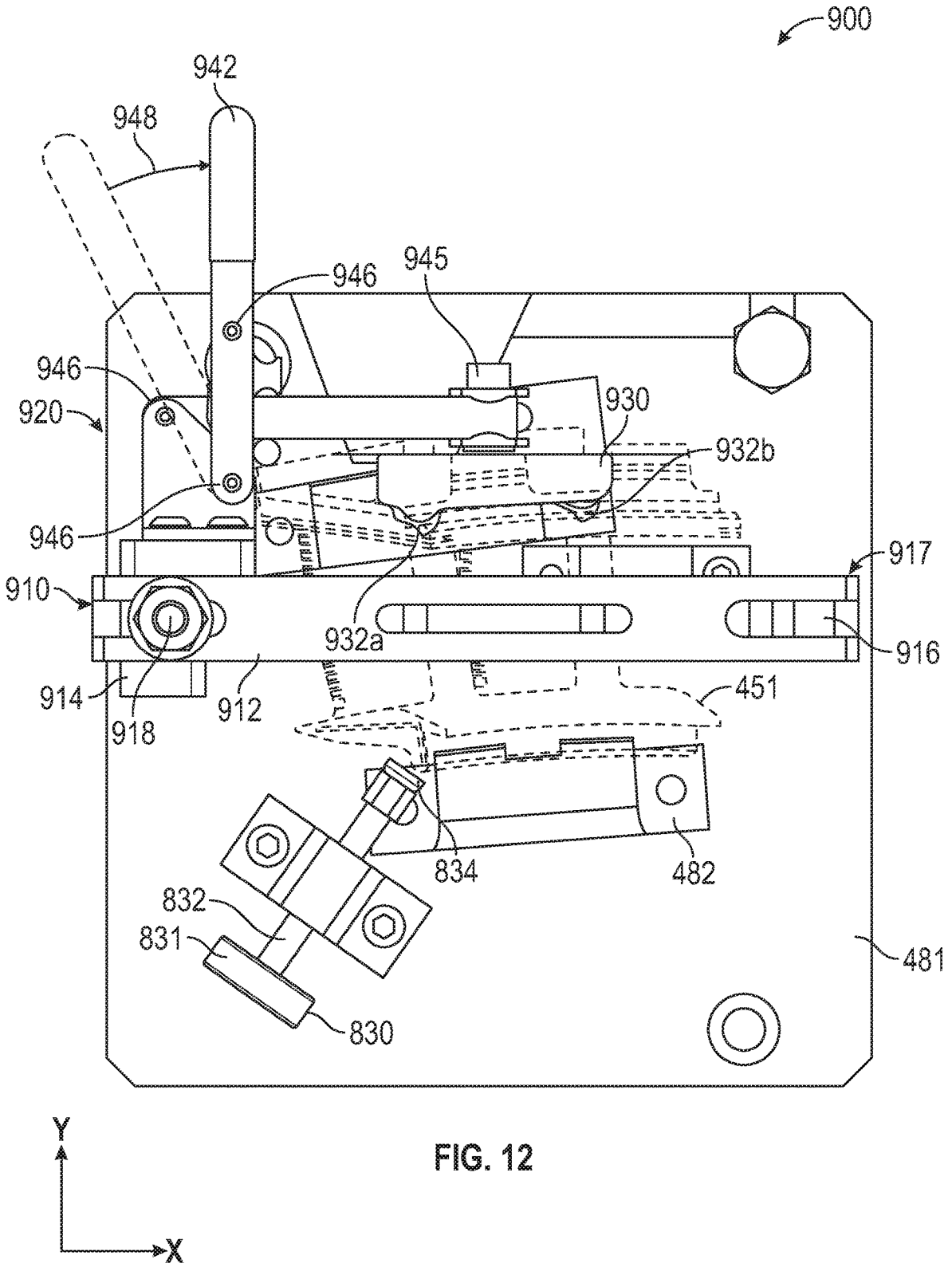
FIG. 12 is a top plan view of the device for sealing the turbine nozzle segment of FIG. 11.

FIG. 12 is a top plan view of the device for sealing the turbine nozzle segment of FIG. 11. The actuation assembly 940 of the device 900 can be moved in a horizontal plane (e.g., the x-y plane, as shown) to move the port seal 930 toward and away from the center of the support assembly 482. This can also move the port seal 930 toward and away from the cooling cavity(ies) 469 of the nozzle segment 451 that is secured by the first clamp assembly 910 and the plunger 830.

In use, the nozzle segment 451 can be placed up on the support assembly 482 of the device 900, and the clamp arm 912 rotated about the pivot point 917 about the y-axis (e.g., in an out of the page). The tightening assembly 918 can be used to secure the nozzle segment 451 between the clamp arm 912 and the support assembly 482. The plunger 830 can be tightened, using the thumb wheel 831 to move the plunger foot 834 (via the threaded post 832) to contact the nozzle segment 451.

Once secured on the support assembly 482, the lever 942 can be moved in the direction of an arrow (direction) 948. The cooperation of the hinge assemblies 946 move the port seal 930 toward the secured nozzle assembly in an arcuate path that lies substantially in the x-y plane.

Figure 13:
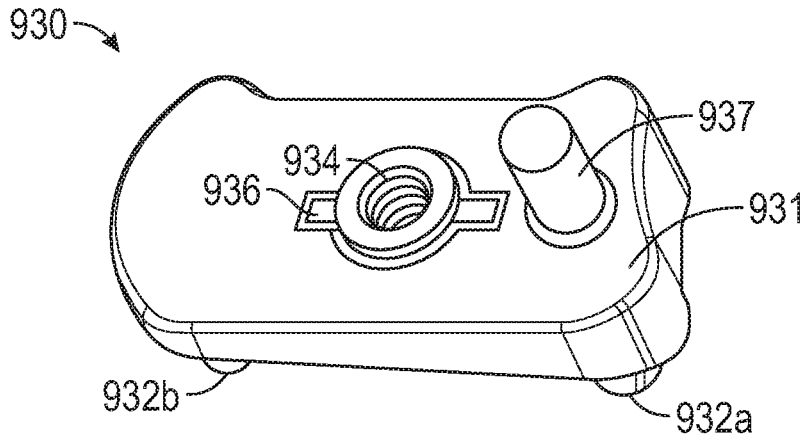
FIG. 13 is a perspective view of the port seal of FIG. 12.

FIG. 13 is a perspective view of the port seal of FIG. 12. The port seal 930 can perform similar functions as the port seal 485, 704, 804, sealing the cooling cavity(ies) 469. The port seal 930 can have a port seal platform 931. The port seal platform 931 can form the structure supporting the other components of the port seal 930. The port seal 930 can have sealing members 932*a*, 932*b* (collectively sealing members 932). The sealing members 932 can be similar to those described above and seal the cooling cavities 469.

The port seal platform 931 can have a connection point 934. The connection point 934 can be a threaded cavity, for example. The connection point 934 can couple the port seal 930 to the actuation arm 944 via hardware 945 (FIG. 11) having corresponding external threads, for example. The hardware 945 can be a nut, bolt, washer, or other applicable hardware to attach the port seal 930 to the actuation arm 944 and the rest of the port seal assembly 920. The connection point 934 can thus be, for example, a threaded channel (as shown) formed to receive a threaded post (e.g., the hardware 945).

Figure 14:
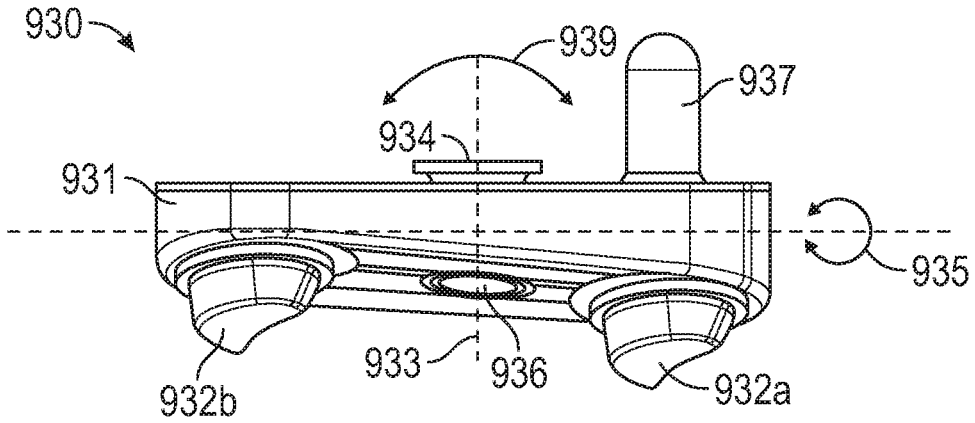
FIG. 14 is an elevation view of the port seal of FIG. 13.

FIG. 14 is an elevation view of the port seal of FIG. 13. The connection point 934 can fit within a flex hinge 936. The flex hinge can allow motion in two of three axes. For example, the flex hinge 936 can a small amount of flexion about a longitudinal axis in a direction shown by the arrows (direction) 935 and in a direction described by an arrow (direction) 939, but inhibit rotation about a vertical axis 933. The ability to flex in two of three axes provide a more secure fit for the sealing members 932 within the cooling cavity (ies) 469.

The port steal 930 can also have a guide post 937. The guide post 937 can fit within a corresponding structure in the actuation arm 944 (not shown) to further restrict movement of the flex hinge 936 about the axis 933.

INDUSTRIAL APPLICABILITY

During manufacturing, the nozzle segments 451 that form a gas turbine nozzle 450 can be cast from one or more metallic materials. The cast nozzle segments 451, can have the cooling cavities 469 that allow air to flow and cool the nozzle 450 when in use within the gas turbine engine 100. Cooling air can be directed into the cooling cavities 469 can out a plurality of cooling holes or apertures, such as leading edge cooling apertures 466. The leading edge cooling apertures 466 can be pressure side cooling apertures and/or showerhead cooling apertures. The airfoil 460 can also have trailing edge cooling apertures 467. Each cooling hole or cooling aperture 466, 467 may be a channel extending through a wall of the airfoil 460. Each set of cooling apertures 466 may be grouped together in a pattern, such as in a row or in a column. Such apertures are very fine and easily clogged with the introduction of particular matter into the cooling apertures.

During manufacturing, certain applications for the nozzle segments can require additional machining or milling prior to installation in the gas turbine engine 100. Thus, the device for sealing the turbine nozzle segment 480, 700, 800, 900 can be implemented to seal the openings of the cooling cavities 469 and prevent intrusion of any particles or other contaminants that may be created or introduced during milling of the nozzle segment 451.

In the embodiments described herein, the nozzle segment 451 requiring further milling, can be secured upon the support assembly 482 by one or more clamp assemblies. One or more port seals can then be engaged to the openings of the cooling cavity(ies) 469 to prevent contamination.

It will be understood that the benefits and advantages described above may relate to one embodiment or may relate to several embodiments. The embodiments are not limited to those that solve any or all of the stated problems or those that have any or all of the stated benefits and advantages.

Any reference to 'an' item refers to one or more of those items. The term 'comprising' is used herein to mean including the method blocks or elements identified, but that such blocks or elements do not comprise an exclusive list and a method or apparatus may contain additional blocks or elements.

What is claimed is:

1. A device for securing a gas turbine nozzle segment and sealing one or more cooling cavities of the gas turbine nozzle segment during manufacturing, the device comprising:

a support assembly for receiving a nozzle segment having at least one cooling cavity;

a first clamp assembly configured to secure a first portion of the nozzle segment to the support assembly, the first clamp assembly having a first clamp arm, and a first tightening assembly coupling the first clamp arm to the support assembly;

a first port seal assembly having a first seal body hingeably attached to the support assembly, and at least one sealing member coupled to the first seal body and configured to interact with and seal the corresponding one or more cooling cavities.

2. The device of claim 1, further comprising:

a second clamp assembly disposed opposite the first clamp assembly, and configured to secure a second portion of the nozzle segment to the support assembly, the second clamp assembly having a second clamp arm, and a second tightening assembly coupling the second clamp arm to the support assembly;

a first actuation arm coupled to the first seal body of the first port seal assembly; and a first hinge assembly coupling the first actuation arm to the first clamp assembly, and configured to allow the first seal body and the at least one sealing member move in an arcuate path to interact with and seal the corresponding one or more cooling cavities.

3. The device of claim 1, further comprising:

a second clamp assembly, the second clamp assembly configured to secure a second portion of the nozzle segment to the support assembly, the second clamp assembly having a second tightening assembly coupling the first clamp arm to the support assembly; and a second port seal assembly having a second seal body hingeably attached to the support assembly, and at least one sealing member coupled to the second seal body and configured to interact with and seal the corresponding one or more cooling cavities opposite the first port seal assembly.

4. The device of claim 3, wherein the second seal body is configured to move in an arcuate path substantially perpendicular to the support assembly.

5. The device of claim 1, comprising a hinge assembly hingeably coupling the first clamp arm to the support assembly, and configured to allow the first clamp arm to move in an arcuate path, substantially orthogonal with the support assembly.

6. The device of claim 3, wherein the second seal body is configured to hingeably move in an arcuate path, substantially parallel with the support assembly.

7. A device for sealing one or more cooling cavities of a gas turbine nozzle segment during manufacturing, the device comprising:

a support assembly for receiving a nozzle segment having at least one cooling cavity;

a first clamp assembly configured to secure a first portion of the nozzle segment to the support assembly, the first clamp assembly having a first clamp arm, a first hinge assembly, a first port seal coupled to the first clamp arm by the first hinge assembly, the first port seal having at least one sealing member configured to interact with the corresponding one or more cooling cavities, and a first tightening assembly coupling the first clamp arm to the support assembly and allowing the first clamp assembly to selectively move toward and away from a center of the support assembly;

a second clamp assembly disposed on a second side of the support assembly and configured to secure a second portion of the nozzle segment, the second clamp assembly having, a second clamp arm, and a second tightening assembly coupling the second clamp arm to the support assembly and allowing the second clamp assembly to selectively move toward and away from the center of the support assembly, opposite the first clamp assembly.

8. The device of claim 7, wherein the first hinge assembly is configured to allow the first port seal to rotate in an arcuate path substantially perpendicular to the support assembly.

9. The device of claim 7, wherein the support assembly comprises a groove, the groove having a curved shape formed to receive corresponding features of the nozzle segment.

10. The device of claim 7, wherein the first clamp arm has a clamp arm end having a curved end configured to contact with the nozzle segment.

11. The device of claim 7, wherein the first clamp assembly is disposed on a first side of the support assembly and the second clamp assembly is disposed on a second side of the support assembly opposite the first side.

12. A device for sealing one or more cooling cavities of a gas turbine nozzle segment during manufacturing, the device comprising: a support assembly for receiving a nozzle segment having at least one cooling cavity; a first clamp assembly configured to secure the nozzle segment, the first clamp assembly having a clamp arm, and a tightening assembly coupling the first clamp arm to the support assembly; a port seal having a first seal body, and at least one sealing member coupled to the first seal body and configured to interact with and seal the corresponding one or more cooling cavities; and an actuation assembly having an actuation arm, a lever and one or more hinge assemblies, the lever coupled to the port seal via the actuation arm [944] and the one or more hinge assemblies.

13. The device of claim 12 wherein the clamp arm is hingeably coupled to the support assembly.

14. The device of claim 13, wherein the support assembly comprises a groove, the groove having a curved shape formed to receive corresponding features of the nozzle segment.

15. The device of claim 14, further comprising a plunger assembly having a thumb wheel and threaded post, configured to adjust an orientation of the nozzle segment upon the support assembly.

* * * * *